US008037558B1

(12) United States Patent
Chen

(10) Patent No.: US 8,037,558 B1
(45) Date of Patent: Oct. 18, 2011

(54) WASH BASIN DRAIN STRUCTURE

(75) Inventor: Chao Chi Chen, Changhua (TW)

(73) Assignee: Shower Kaokang Enterprise Co., Ltd., Changhua County (TW)

( * ) Notice: Subject to any disclaimer, the term of this patent is extended or adjusted under 35 U.S.C. 154(b) by 0 days.

(21) Appl. No.: 12/971,110

(22) Filed: Dec. 17, 2010

(51) Int. Cl.
*E03C 1/23* (2006.01)

(52) U.S. Cl. ..... 4/689; 4/690; 4/691; 4/692

(58) Field of Classification Search ..... 4/684, 689, 4/690–692; 285/322–324
See application file for complete search history.

(56) References Cited

U.S. PATENT DOCUMENTS 2,496,402 A * 2/1950 McVeigh et al. ..... 242/118.5
4,218,785 A * 8/1980 Crawford et al. ..... 4/692
5,520,802 A * 5/1996 Brubaker ..... 210/172.6
2010/0154114 A1* 6/2010 Van Zeeland et al. ..... 4/689
* cited by examiner

*Primary Examiner* — Gregory Huson
*Assistant Examiner* — Erin Deery
(74) *Attorney, Agent, or Firm* — Ming Chow; Sinorica, LLC

(57) ABSTRACT

A wash basin drain structure includes a tightening assembly, a control rod assembly, a drain pipe, and a plug. A threaded top ring of the fastening assembly relative to a threaded annular seat is screwed reversely to push an anti-leakage washer of the drain pipe upward, so that the threaded top ring and a washer are against the bottom of the wash basin and resilient portions of the resilient ring engages with a non-slip portion of the drain pipe. When a threaded fixing member in a threaded hole of a fixing seat of the control rod assembly is screwed inward, the end of the threaded fixing member will hold against the body of the drain pipe and pull an inner pipe portion of the fixing seat to seal and engage with an insertion hole of the drain pipe. A magnetic end head of a link rod of the control rod assembly is attracted to connect with a magnetic portion of a plug body of the plug to act as a lever. The present invention can be assembled with ease.

5 Claims, 6 Drawing Sheets

WASH BASIN DRAIN STRUCTURE

BACKGROUND OF THE INVENTION

1. Field of the Invention

The present invention relates to a wash basin drain structure.

2. Description of the Prior Art

As shown in FIG. 6, a conventional drain structure comprises a drain pipe (50), a lock ring (60), a plug (70), and a control assembly (80). The drain pipe (50) comprises a pipe connector (51) at one side thereof. The pipe connector (51) has a bushing (510) therein. The drain pipe (50) further comprises a gasket (52) on the body of the drain pipe (50) and a hexagon tightening nut (53) under the gasket (52). The plug (70) comprises a plug cover (71) at one end hereof, a stop ring (710) under the plug cover (71), and a through hole (72) at another end of the plug (70). The control assembly (80) comprises an action rod (81). The action rod (81) has a ball shaft (810) and a screw nut (82) at an inner end of the action rod (81). The drain pipe (50) is inserted out of the drain hole of the wash basin from bottom to top, and then locked by the lock ring (60). The gasket (52) of the drain pipe (50) is attached under the drain hole of the wash basin and tightened by the hexagon tightening nut (53) under the gasket (52), such that the wash basin and the drain pipe (52) are tightly connected to prevent water from leakage. The plug (70) is inserted in the drain pipe (50). The end of the action rod (81) of the control assembly (80) is inserted through the pipe connector (51) of the drain pipe (50), and the ball shaft (810) of the action rod (81) is slid in the pipe connector (51) and blocked by the bushing (510) of the pipe connector (51). The screw nut (82) of the action rod (81) is screwed to the pipe connector (51), so that the control assembly (80) acts like a lever with the ball shaft (810) as the fulcrum. When the action rod (81) is pulled upward to link the plug (70) to move downward, the stop ring (710) under the plug cover (71) of the plug (70) is to cover the opening of the drain pipe (50). When the action rod (81) is pressed downward to link the plug (70) to move upward, the water in the wash basin is discharged through the opening of the drain pipe (50). However, the conventional drain structure has some shortcomings:

1. Inconvenient to use: When the drain pipe is coupled to the wash basin, the drain pipe is inserted out of the drain hole of the wash basin from bottom to top and then locked by the lock ring from the top. The gasket of the drain pipe is attached under the drain hole of the wash basin and tightened by the hexagon tightening nut under the gasket. The end of the action rod of the control assembly must be aimed at the insertion hole of the plug, which is not easy for connection. It is inconvenient to use.

2. Difficult connection: When the drain pipe is coupled to the wash basin, the drain pipe is inserted out of the drain hole of the wash basin from bottom to top and then locked by the lock ring from the top. The gasket of the drain pipe is attached under the drain hole of the wash basin and tightened by the hexagon tightening nut under the gasket. The connection and assembly is complicated and difficult.

Accordingly, the inventor of the present invention has devoted himself based on his many years of practical experiences to provide these problems.

SUMMARY OF THE INVENTION

The primary object of the present invention is to provide a wash basin drain structure which comprises a fastening assembly, a control rod assembly, a drain pipe and a plug. The tightening assembly comprises a washer, a threaded top ring, a resilient ring and a threaded annular seat. The control rod assembly comprises a fixing seat and a link rod. The fixing seat comprises an outer pipe portion and an inner pipe portion. The link rod comprises a magnetic end head. The magnetic end head of the link rod is inserted through the outer pipe portion. The link rod is movably connected to the outer pipe portion of the fixing seat. The drain pipe comprises a top hole portion and a side hole portion. An anti-leakage washer, an insertion hole and a non-slip portion are provided below the side hole portion. The drain pipe has a body inserting through the washer, the threaded top ring, the resilient ring and the threaded annular seat of the fastening assembly. The resilient ring is elastically engaged on the non-slip portion of the drain pipe. The fixing seat of the control rod assembly is fitted on the drain pipe. The inner pipe portion of the fixing seat corresponds to the insertion hole of the drain pipe. The magnetic end head of the link rod of the control rod assembly is inserted through the insertion hole. The plug comprises a plug body, a magnetic portion at one end of the plug body, a plug portion at another end of the plug body, and a plug washer below the plug portion. The plug body is inserted in the top hole portion of the drain pipe. The plug portion and the plug washer of the plug body are used to plug an open end of the top hole portion of the drain pipe. The magnetic portion of the plug body is used to attract the magnetic end head of the link rod in the insertion hole of the drain pipe.

DETAILED DESCRIPTION OF THE PREFERRED EMBODIMENTS

Embodiments of the present invention will now be described, by way of example only, with reference to the accompanying drawings.

Figure 1:
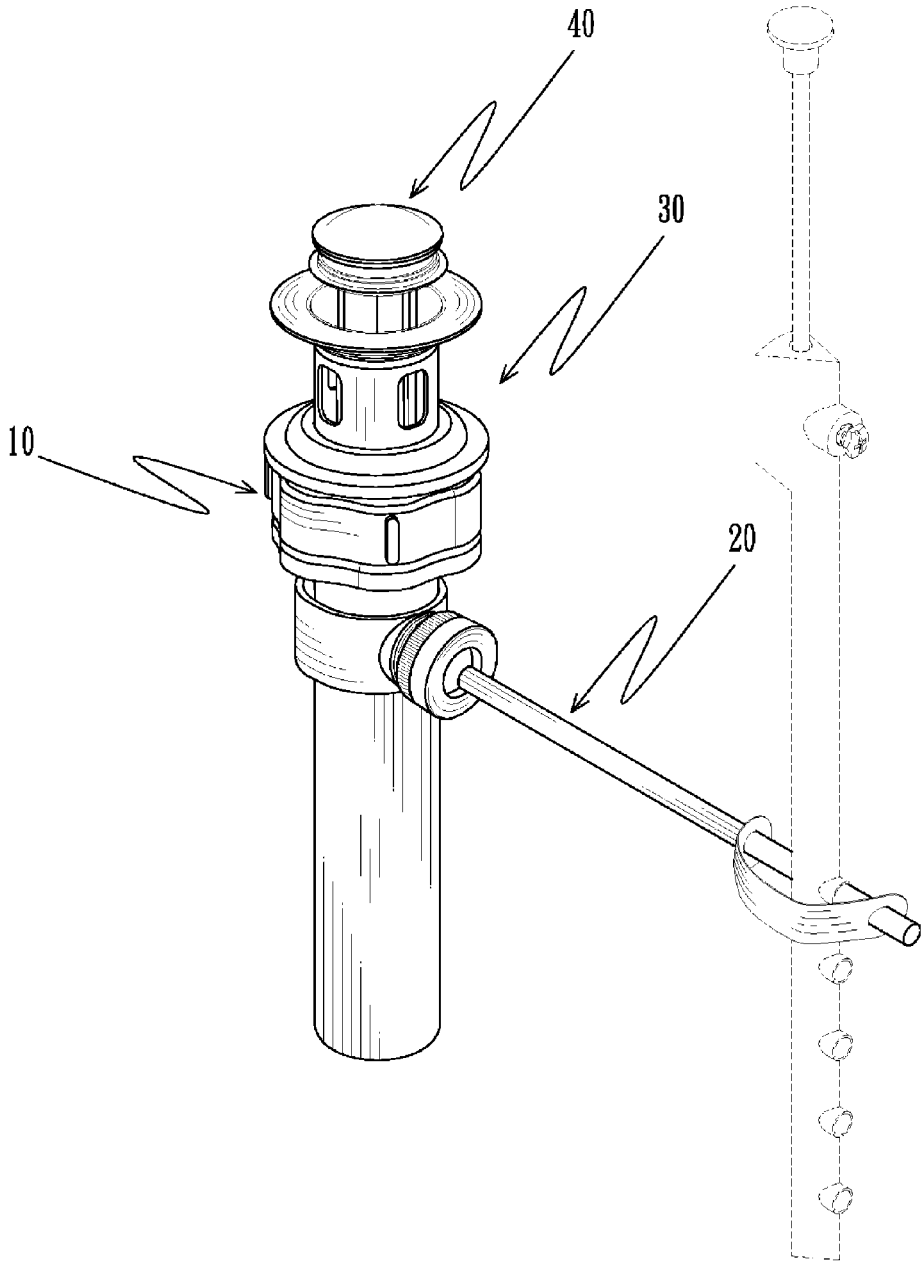
FIG. 1 is a perspective view of the present invention.
Figure 2:
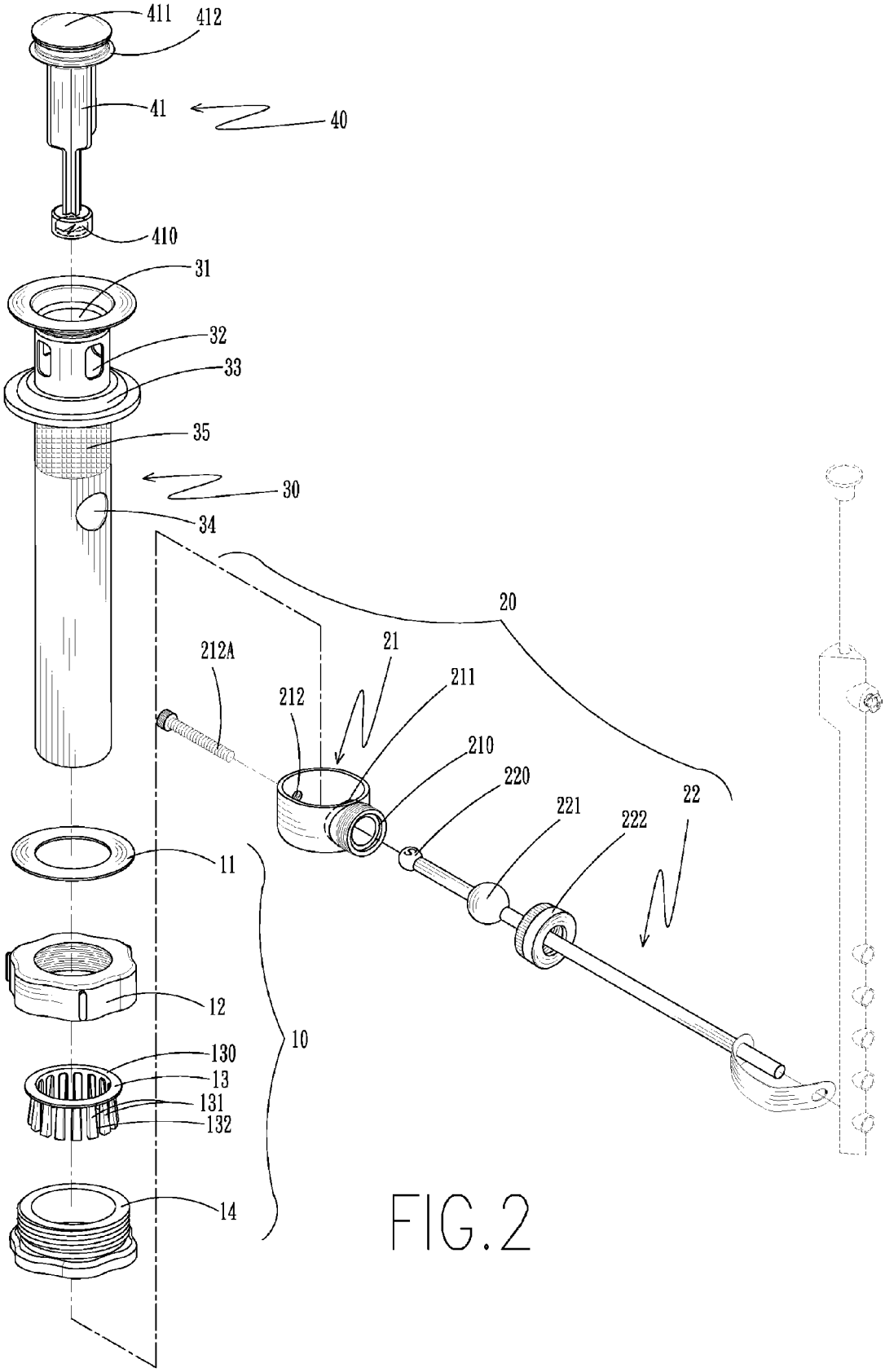
FIG. 2 is an exploded view of the present invention.
Figure 3:
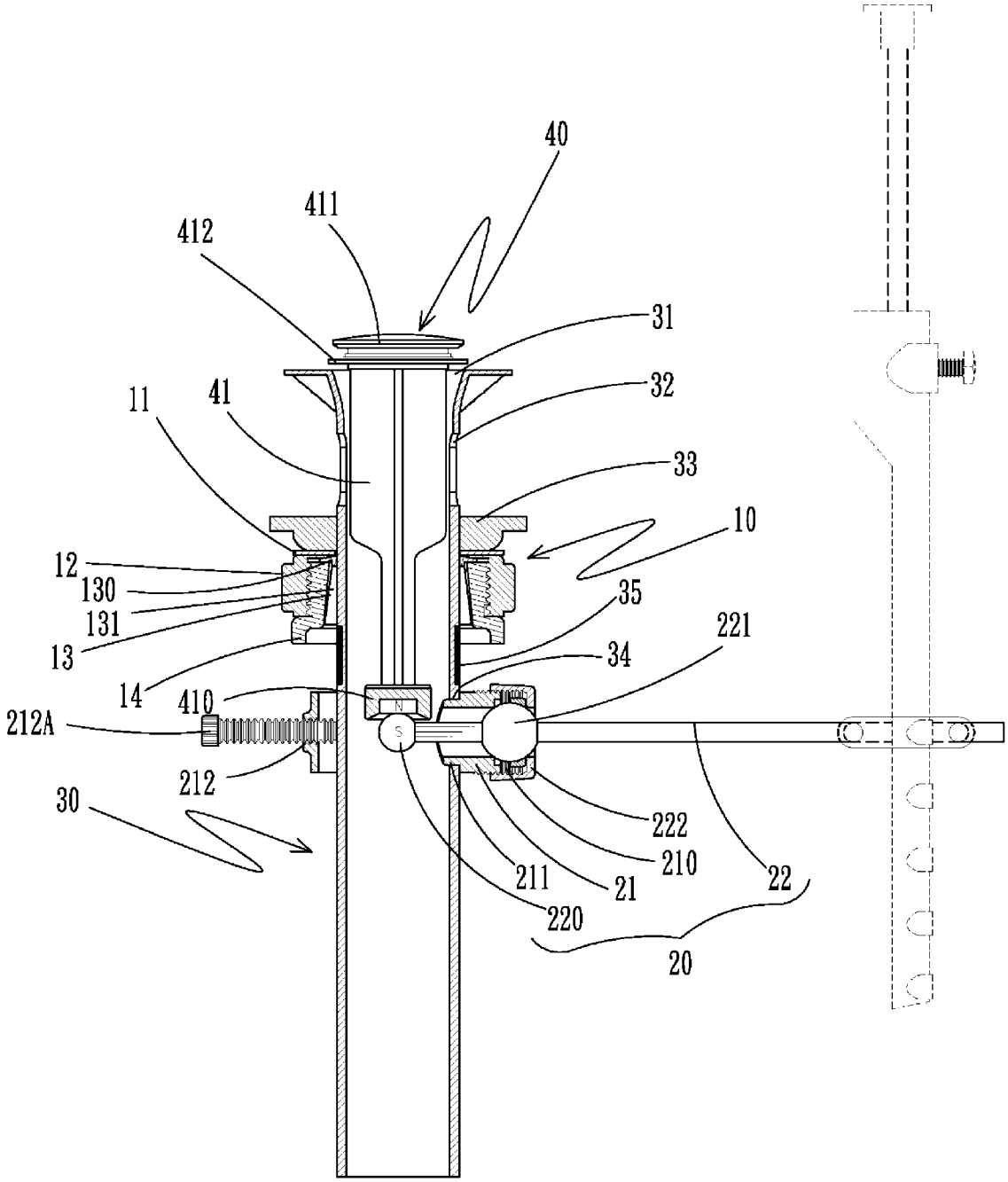
FIG. 3 is a cross-sectional view of the present invention.

As shown in FIG. 1 to FIG. 3, a wash basin drain structure according to a preferred embodiment of the present invention comprises a tightening assembly (10), a control rod assembly (20), a drain pipe (30), and a plug (40).

The fastening assembly (10) comprises a washer (11), a threaded top ring (12), a resilient ring (13) and a threaded annular seat (14). The resilient ring (13) comprises a ring portion (130), a plurality of resilient portions (131) and a plurality of limit grooves (132) below the ring portion (130).

The control rod assembly (20) comprises a fixing seat (21) and a link rod (22). The fixing seat (21) comprises an outer pipe portion (210), an inner pipe portion (211), and a threaded hole (212). The threaded hole (212) is provided with a threaded fixing member (212A). The link rod (22) comprises a magnetic end head (220), a movable ball portion (221), and a lock ring (222). The magnetic end head (220) of the link rod (22) is inserted through the outer pipe portion (210). The movable ball portion (221) of the link rod (22) is engaged in the outer pipe portion (210) of the fixing seat (21). The lock ring (222) of the link rod (22) is threadedly connected to the outer pipe portion (210) of the fixing seat (21).

The drain pipe (30) comprises a top hole portion (31) and a side hole portion (32). An anti-leakage washer (33), an insertion hole (34) and a non-slip portion (35) are provided below the side hole portion (32). The non-slip portion (35) is an embossing portion on the drain pipe (30). The drain pipe (30) has a body inserting through the washer (11), the threaded top ring (12), the resilient ring (13) and the threaded annular seat (14) of the fastening assembly (10). The resilient portions (131) and the limit grooves (132) below the ring portion (130) of the resilient ring (13) are elastically engaged on the non-slip portion (35) of the drain pipe (30). The fixing seat (21) of the control rod assembly (20) is fitted on the drain pipe (30). The inner pipe portion (211) of the fixing seat (21) corresponds to the insertion hole (34) of the drain pipe (30). When the threaded fixing member (212A) in the threaded hole (212) of the fixing seat (21) is screwed inward, the end of the threaded fixing member (212A) will hold against the body of the drain pipe (30) and pull the inner pipe portion (211) of the fixing seat (21) to seal and engage with the insertion hole (34) of the drain pipe (30). The magnetic end head (220) of the link rod (22) of the control rod assembly (20) is inserted through the insertion hole (34).

The plug (40) comprises a plug body (41), a magnetic portion (410) at one end of the plug body (41), a plug portion (411) at another end of the plug body (41), and a plug washer (412) below the plug portion (411). The plug body (41) is inserted in the top hole portion (31) of the drain pipe (30). The plug portion (411) and the plug washer (412) of the plug body (41) are used to plug an open end of the top hole portion (31) of the drain pipe (30). The magnetic portion (410) of the plug body (41) is used to attract the magnetic end head (220) of the link rod (22) in the insertion hole (34) of the drain pipe (30). Thus, the wash basin drain structure is completed.

Figure 4:
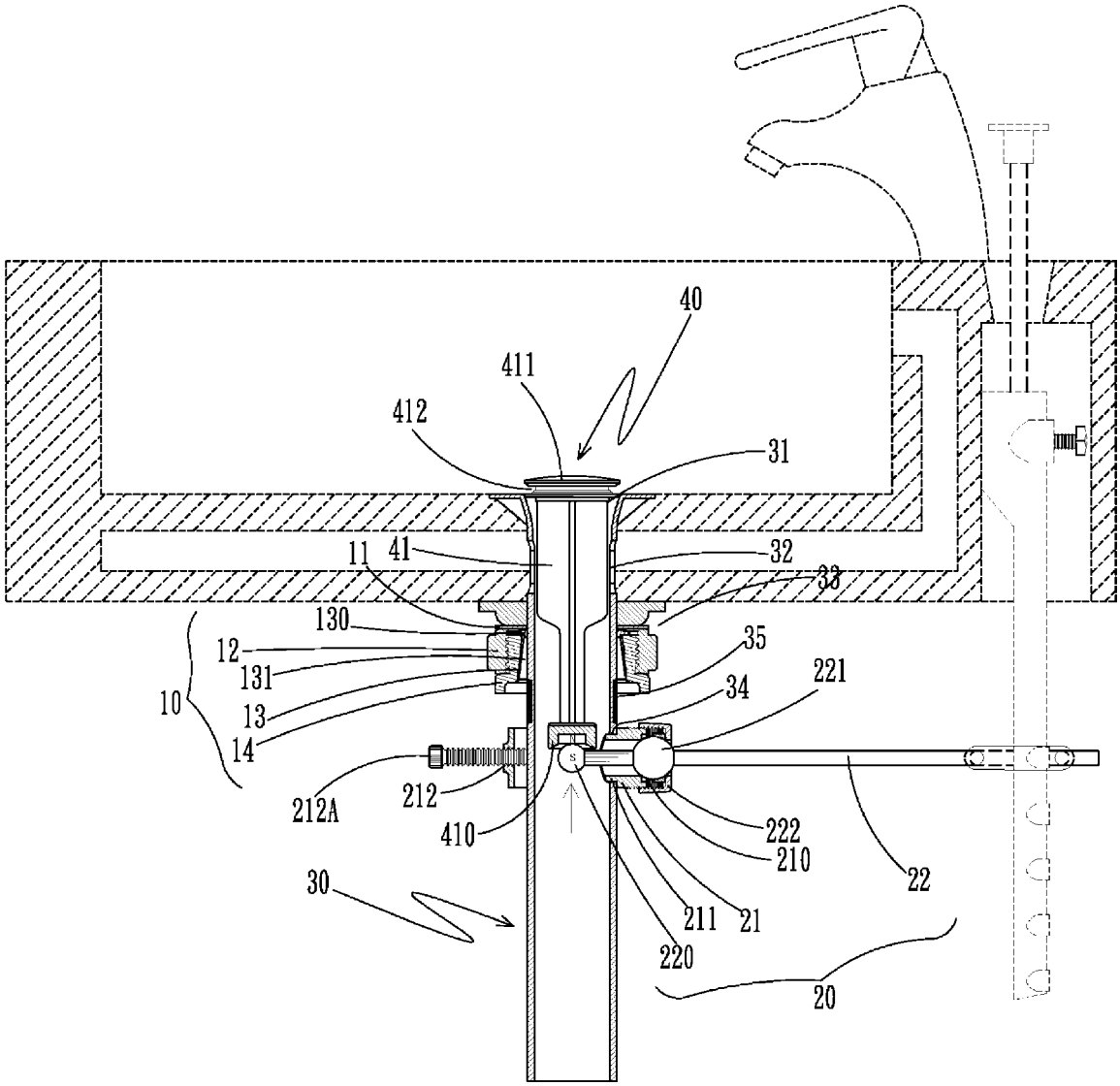
FIG. 4 is a schematic view showing the wash basin drain structure of the present invention coupled to a wash basin.
Figure 5:
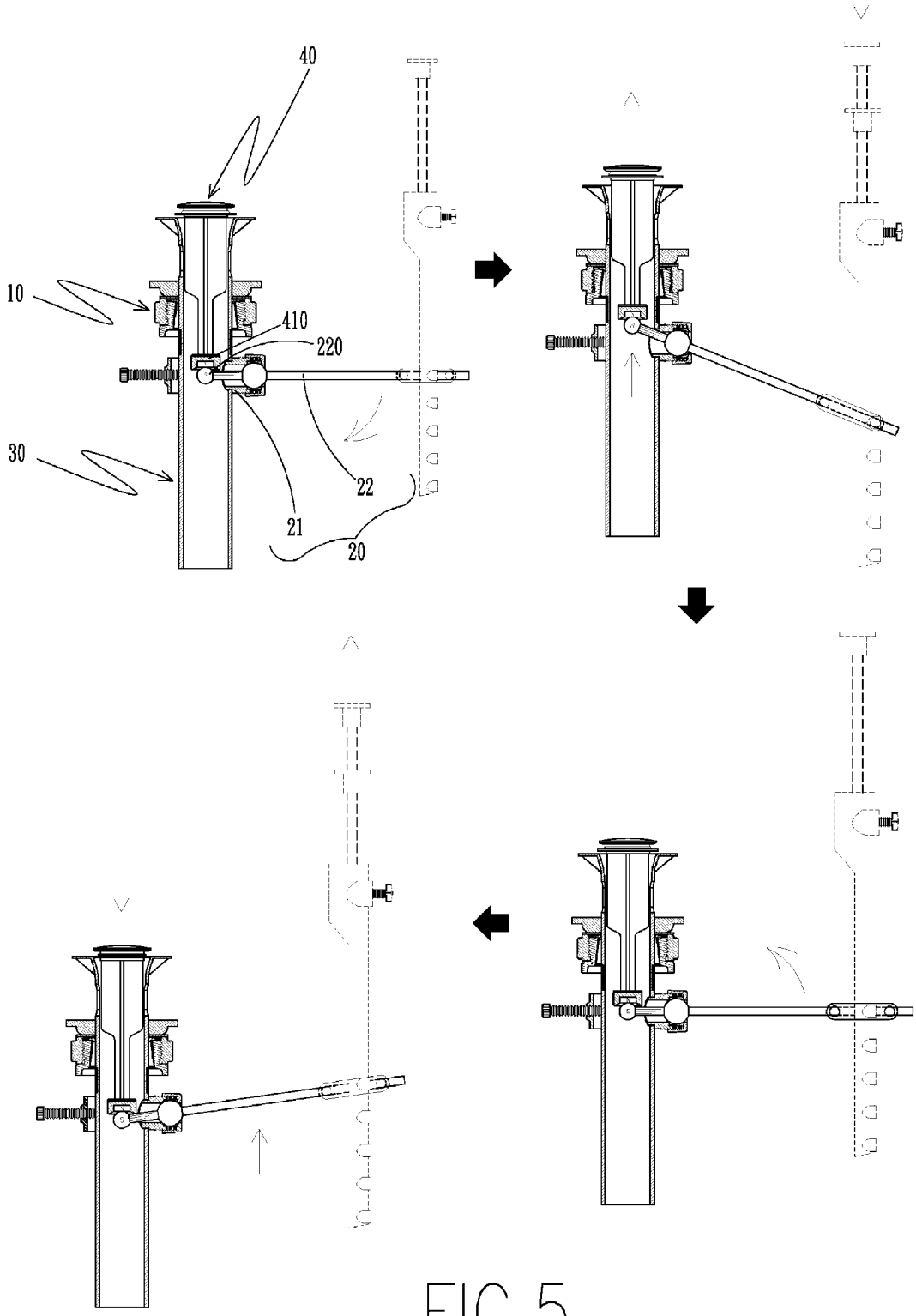
FIG. 5 is a schematic view to show the control rod assembly linking the plug.
Figure 6:
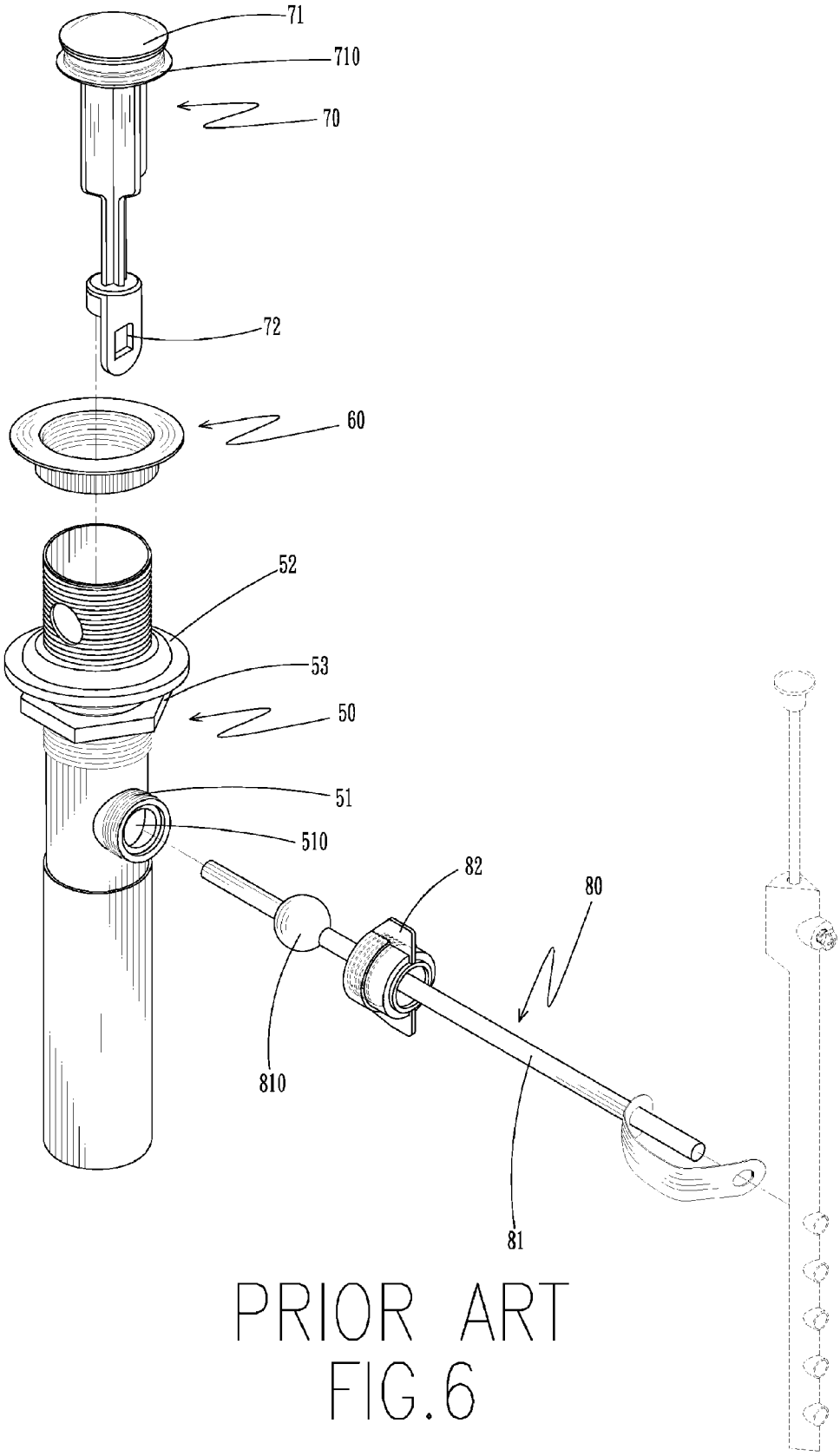
PRIOR ART FIG.6
FIG. 6 is an exploded view of the prior art.

FIG. 4 is a schematic view showing the wash basin drain structure of the present invention coupled to a wash basin. FIG. 5 is a schematic view to show the control rod assembly linking the plug. The threaded top ring (12), the resilient ring (13) and the threaded annular seat (14) of the fastening assembly (10) are first assembled, and then fitted on the body of the drain body (30) with the washer (11). The resilient ring (13) is located between the threaded top ring (12) and the threaded annular seat (14). The fixing ring (21) of the control rod assembly (20) is fitted on the body of the drain pipe (30). The inner pipe (211) of the fixing seat (21) corresponds to the insertion hole (34) of the drain pipe (30). When the threaded fixing member (212A) in the threaded hole (212) of the fixing seat (21) is screwed inward, the end of the threaded fixing member (212A) will hold against the body of the drain pipe (30) and pull the inner pipe portion (211) of the fixing seat (21) to tightly engage with the insertion hole (34) of the drain pipe (30). The magnetic end head (220) of the link rod (22) of the control rod assembly (20) is inserted into the insertion hole (34) of the drain pipe (30) through the outer pipe portion (210) of the fixing seat (21), such that the magnetic end head (220) of the link rod (22) is attracted to connect with the magnetic portion (410) of the plug body (41) of the plug (40). The movable ball portion (221) of the link rod (22) is engaged in the outer pipe portion (210) of the fixing seat (21). The lock ring (222) of the link rod (22) is threadedly connected to the outer pipe portion (210) of the fixing seat (21). The end provided with the magnetic portion (410) of the plug body (41) of the plug (40) is inserted in the top hole portion (31) of the drain pipe (30). The plug washer (412) at the plug portion (411) of the plug body (41) is used to plug an open end of the top hole portion (31) of the drain pipe (30). The drain pipe (30) is inserted in the drain hole of the wash basin. The threaded top ring (12) of the fastening assembly (10) relative to the threaded annular seat (14) is screwed reversely to push the anti-leakage washer (33) of the drain pipe (30) upward, so that the washer (11) and the threaded top ring (12) are against the bottom of the wash basin and the resilient portions (131) of the resilient ring (13) engages with the non-slip portion (35) of the drain pipe (30). The link rod (22) of the control rod assembly (20) links the plug body (40) to act as a lever. The present invention provides a simple assembly, without the need to aim at the holes. It is not necessary to process the threads of the body of the drain pipe (30), so the body of the drain pipe (30) is thin to save the material and the cost. The present invention can be used conveniently and assembled easily.

The present invention has the following advantages:

1. Convenient to use: When the drain pipe is coupled to the wash basin, the drain pipe can be inserted in the drain hole of the wash basin from top to the bottom. The threaded top ring of the fastening assembly relative to the threaded annular seat is screwed reversely to push the anti-leakage washer of the drain pipe upward, so that the washer and the threaded top ring are against the bottom of the wash basin and the resilient portions of the resilient ring engages with the non-slip portion of the drain pipe. The drain pipe and wash basin can be assembled quickly and simply. It is very convenient to use the present invention.

2. Simple assembly: The drain pipe is inserted from the top of the drain hole of the wash basin, and the fastening assembly is used to connect the drain pipe and the wash basin. The threaded fixing member in the threaded hole is only required to secure the fixing seat of the control rod assembly on the body of the drain body. The magnetic end head of the link rod is inserted in the insertion hole of the drain pipe through the insertion hole of the fixing seat to connect with the magnetic portion of the plug body of the plug, simplifying the assembly.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A wash basin drain structure, comprising:

a fastening assembly, the fastening assembly comprising a washer, a threaded top ring, a resilient ring and a threaded annular seat;

a control rod assembly, the control rod assembly comprising a fixing seat and a link rod, the fixing seat comprising an outer pipe portion and an inner pipe portion, the link rod comprising a magnetic end head, the magnetic end head of the link rod being inserted through the outer pipe portion, the link rod being movably connected to the outer pipe portion of the fixing seat;

a drain pipe, the drain pipe comprising a top hole portion and a side hole portion, an anti-leakage washer, an insertion hole and a non-slip portion being provided below the side hole portion, the drain pipe having a body inserting through the washer, the threaded top ring, the resilient ring and the threaded annular seat of the fastening assembly which are assembled, the resilient ring being elastically engaged on the non-slip portion of the drain pipe, the fixing seat of the control rod assembly being fitted on the drain pipe, the inner pipe portion of the fixing seat corresponding to the insertion hole of the drain pipe, the magnetic end head of the link rod of the control rod assembly being inserted through the insertion hole; and a plug, the plug comprising a plug body, a magnetic portion at one end of the plug body, a plug portion at another end of the plug body, and a plug washer below the plug portion, the plug body being inserted in the top hole portion of the drain pipe, the plug portion and the plug washer of the plug body being used to plug an open end of the top hole portion of the drain pipe, the magnetic portion of the plug body being used to attract the magnetic end head of the link rod in the insertion hole of the drain pipe.

2. The wash basin drain structure as claimed in claim 1, wherein the resilient ring comprises a ring portion, a plurality of resilient portions and a plurality of limit grooves below the ring portion, the ring portion of the resilient ring is fitted on the body of the drain pipe, and the resilient portions and the limit grooves of the resilient ring are elastically engaged with the non-slip portion of the drain pipe.

3. The wash basin drain structure as claimed in claim 1, wherein the fixing seat comprises a threaded hole, the threaded hole is provided with a threaded fixing member, when the threaded fixing member in the threaded hole of the fixing seat is screwed inward, the threaded fixing member has an end to hold against the body of the drain pipe and pulls the inner pipe portion of the fixing seat to tightly engage with the insertion hole of the drain pipe.

4. The wash basin drain structure as claimed in claim 1, wherein the link rod comprises a movable ball portion and a lock ring, the movable ball portion of the link rod is engaged in the outer pipe portion of the fixing seat, and the lock ring of the link rod is locked to the outer pipe portion of the fixing seat.

5. The wash basin drain structure as claimed in claim 1, wherein the non-slip portion of the drain pipe is an embossing portion on the drain pipe.

* * * * *